US006289559B1

(12) United States Patent
Langer

(10) Patent No.: US 6,289,559 B1
(45) Date of Patent: Sep. 18, 2001

(54) FASTENING DEVICE FOR APPENDING A PIECE OF JEWELRY TO A JEWELRY CLASP OR THE LIKE

(76) Inventor: Erich Langer, Steyrerstrasse 13, A-4470 Enns (AT)

( * ) Notice: Subject to any disclaimer, the term of this patent is extended or adjusted under 35 U.S.C. 154(b) by 0 days.

(21) Appl. No.: 09/476,513

(22) Filed: Jan. 3, 2000

(30) Foreign Application Priority Data

Jan. 12, 1999 (AT) ..... 16/99 U

(51) Int. Cl.[7] ..... A44B 21/00; A44C 5/00

(52) U.S. Cl. ..... 24/68 J; 24/70 J; 24/71 J; 24/116 A

(58) Field of Search ..... 24/68 J, 69 J, 24/70 J, 71 J, 116 A; 63/3, 7, 8

(56) References Cited

U.S. PATENT DOCUMENTS

| | | | | |
|---|---|---|---|---|
| 839,047 | * | 12/1906 | Sylvester | 24/68 J |
| 1,760,825 | * | 5/1930 | Gagnon | 24/116 A |
| 4,246,679 | * | 1/1981 | Monett | 24/71 J |
| 4,377,078 | * | 3/1983 | Block | 24/116 A |
| 5,653,009 | * | 8/1997 | Kassardjian | 24/71 J |

FOREIGN PATENT DOCUMENTS 2 269 627 2/1994 (GB) .

* cited by examiner

*Primary Examiner*—Victor N. Sakran
(74) *Attorney, Agent, or Firm*—Collard & Roe, P.C.

(57) ABSTRACT

To achieve a safe and easy-to-handle connection, a fastening device for appending a piece of jewelry (1) to a jewelry clasp (2) or the like, which has a connecting piece (3) with a lug (6) attached in the vicinity of a surface indentation (4) for accommodating the end of a necklace or tie-on thread (7), is characterized in that of the lug (6) which is open at a point of separation (8) one of the end portions (9) on the side of the point of separation is fixed at the connecting piece (3) along the edge (5) of the surface indentation (4), and the other end portion (10) is bent up from the edge (5) of the surface indentation (4), that upon introducing a necklace or tie-on thread (7) through the expanded point of separation (8) the bent-up end portion (10) can be pressed down onto the edge (5) of the surface indentation (4), and that the clear inner width (a) of the lug (6) is smaller than the clear inner width (c) of the edge (5) of the indentation and smaller than the outer width (b) of the thickened end portion (11) to be pressed into the surface indentation (4).

3 Claims, 2 Drawing Sheets

FASTENING DEVICE FOR APPENDING A PIECE OF JEWELRY TO A JEWELRY CLASP OR THE LIKE

FIELD OF THE INVENTION

This invention relates to a fastening device for appending a piece of jewelry to a jewelry clasp or the like, which has a connecting piece with a lug attached in the vicinity of a surface indentation for accommodating the end of a necklace or tie-on thread. Piece of jewelry is meant to include above all necklaces, necklace parts, but also pendants, and jewelry clasp or the like is meant to include not only a true clasp but also pins and brooches, intermediate pieces of a necklace or other decorative parts of a piece of jewelry.

DESCRIPTION OF THE PRIOR ART

For appending a piece of jewelry to a jewelry clasp or the like, known fastening devices require an additional connecting element, mostly a ring, which on the one hand engages in the piece of jewelry and on the other hand in the connecting piece of the jewelry clasp or the like, whereby not only the manufacture of these fastening devices becomes rather expensive, but the area where the piece of jewelry is appended quite conspicuously stands out against the remaining piece of jewelry due to the additional connecting element and impairs the esthetic appearance of this piece of jewelry.

SUMMARY OF THE INVENTION

It is therefore the object underlying the invention to create a fastening device as described above, which involves a safe and yet economic connection of piece of jewelry and jewelry clasp or the like, and without a disturbing influence on the total esthetic appearance of the jewelry leads to a smooth transition between the piece of jewelry and the jewelry clasp.

This object is solved by the invention in that of the lug which is open at a point of separation one end portion on the side of the point of separation is fixed at the connecting piece along the edge of the surface indentation, and the other end portion is bent up from the edge of the surface indentation, that upon introducing a necklace or tie-on thread forming a thickened end portion through the expanded point of separation, the bent-up end portion can be pressed down onto the edge of the surface indentation, and that the clear inner width of the lug is smaller than the clear inner width of the edge of the indentation and smaller than the outer width of the thickened end portion which can be pressed into the surface indentation.

Due to the open and drawn-up lug sufficient room is available for introducing the thickened end portion of a necklace or tie-on thread into the lug, whereupon the lug is closed by pressing down the bent-up end portion, and the thickened end portion is retained inside the surface indentation. Appending a piece of jewelry to a jewelry clasp or the like can therefore be performed quickly and easily and makes the use of an additional connecting element superfluous, where a neat and smooth attachment of the piece of jewelry to be appended to a jewelry clasp, an intermediate part or the like is achieved.

When appending a knotted pearl necklace to a jewelry clasp, the knot after the last pearl is advantageously provided itself as a thickened end portion of the necklace thread, so that the connecting piece can follow the last pearl without a major distance, and the jewelry clasp perfectly fits in the overall picture of the necklace.

When anchoring parts adhered or clamped to the thread end form the thickened end portion, the fastening device can optimally be adapted to the respective pieces of jewelry and always ensures a safe and easy-to-handle connection.

BRIEF DESCRIPTION OF THE DRAWING

In the drawing, the subject-matter of the invention is illustrated purely schematically with reference to an embodiment, wherein.

DESCRIPTION OF THE PREFERRED EMBODIMENT

Figure 1:
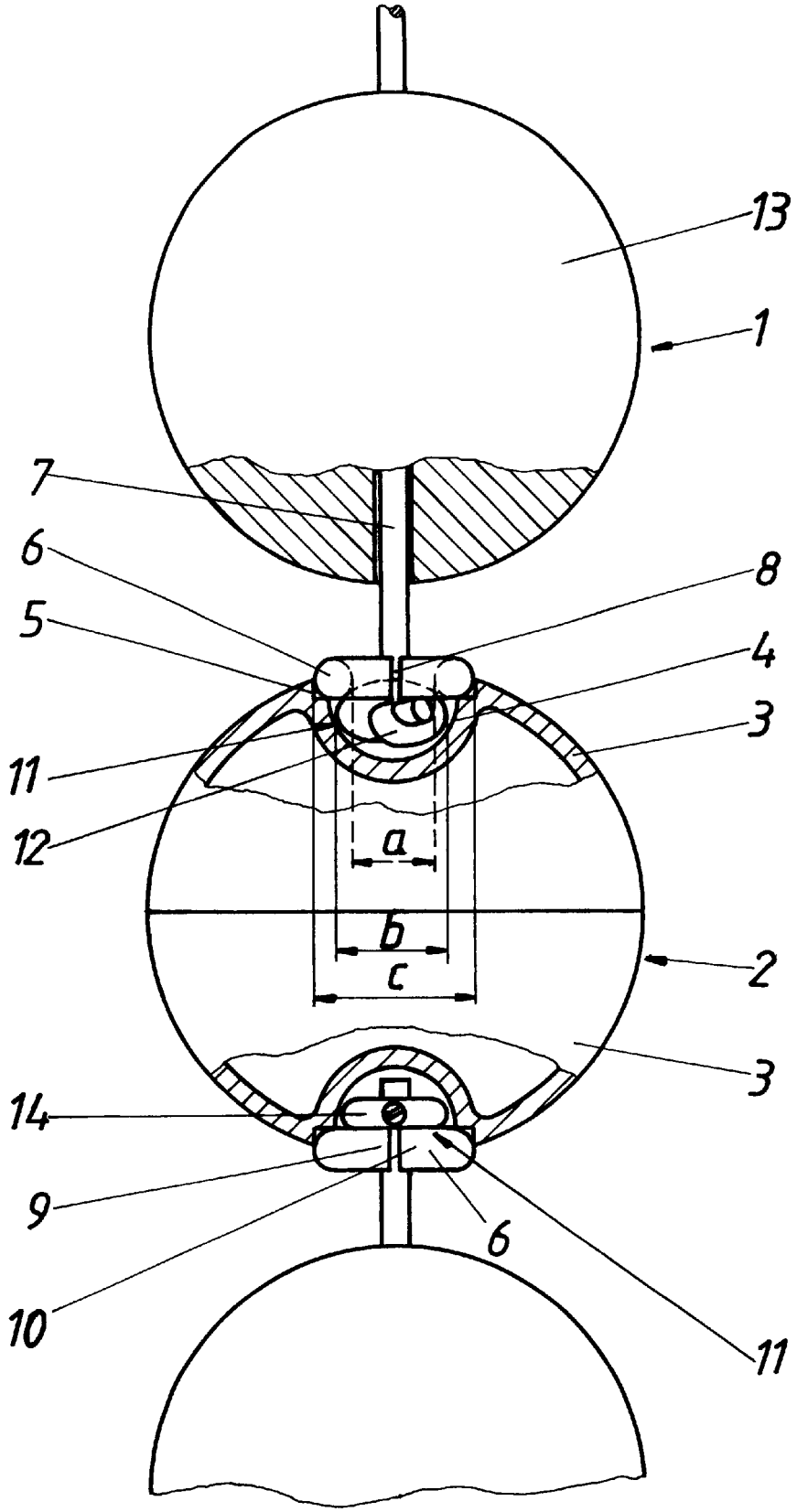
FIG. 1 shows a side view of a pearl necklace appended to a jewelry clasp by means of an inventive fastening device in a partial section.
Figure 2:
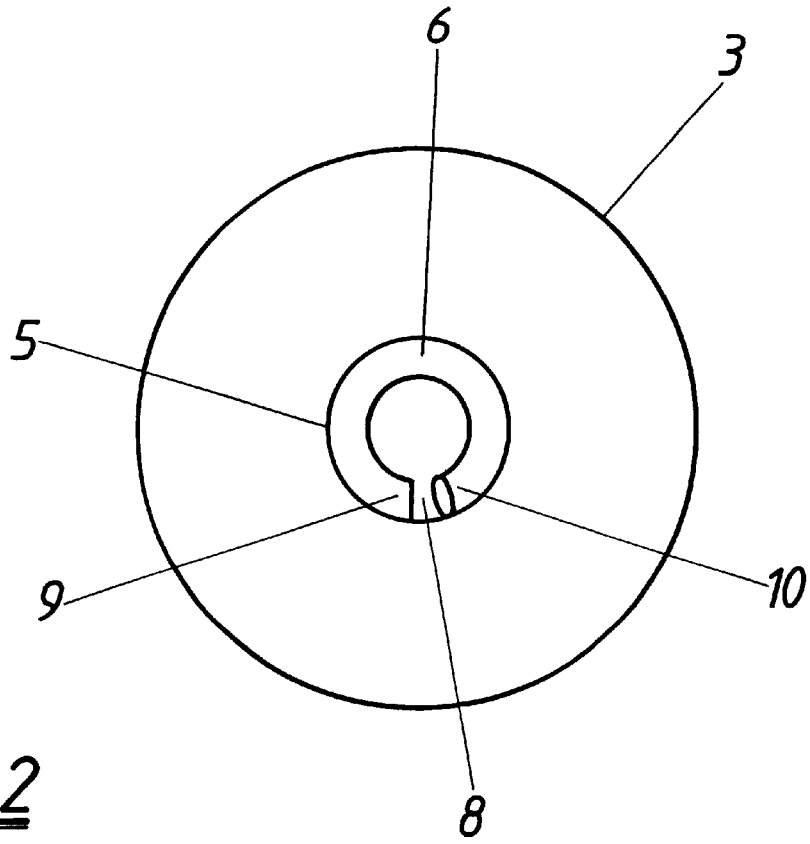
FIGS. 2 and 3 show the connecting piece of this jewelry clasp with the associated parts of the inventive fastening device in a top view and in a side view in a partial section.
Figure 3:
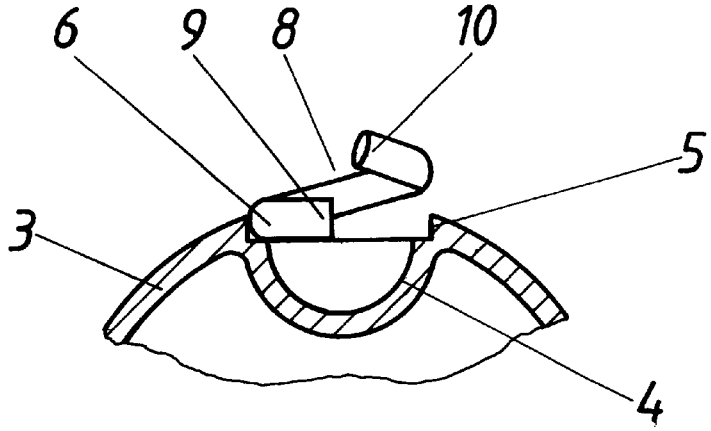

A pearl necklace 1 is appended at both ends to a jewelry clasp 2, where the two clasp parts of the jewelry clasp 2, which belong together, form connecting pieces 3 for appending the pearl necklace 1. At oppositely located points, these connecting pieces 3 have a surface indentation 4 for the attachment of the necklace, at whose edge 5 a lug 6 is seated for accommodating the necklace thread 7. Of the lug 6, which is open at a point of separation 8, one end portion 9 on the side of the point of separation is fixed at the connecting piece 3 along the edge 5 of the surface indentation 4 and is bent up from the edge 5 of the surface indentation 4 for producing the tie-on connection with the other end portion 10 (FIGS. 2 and 3). Upon introducing the necklace thread 7, which has a thickened end portion 11, through the expanded point of separation 8, this bent-up end portion 10 is then pressed down onto the edge 5 of the surface indentation 4, and thus the necklace thread 7 is connected with the connecting piece 3. To ensure this firm connection, the clear inner width a of the lug 6 is smaller than the outer width b of the thickened end portion 11 finding room in the surface indentation 4 and also smaller than the clear inner width c of the edge 5 of the indentation. As thickened end portion 11 there is used the knot 12 of the necklace thread 7 for the last pearl 13 or an anchoring portion 14 adhered or clamped to the thread end.

A safe and easy-to-handle connection between a piece of jewelry and a jewelry clasp or the like is thus achieved in an economic way, where a neat and smooth transition between the piece of jewelry and the jewelry clasp is obtained.

What is claimed is:

1. A fastening device for appending a piece of jewelry (1) to a jewelry clasp (2) or the like, which has a connecting piece (3) with a lug (6) attached in the vicinity of a surface indentation (4) for accommodating the end of a necklace or tie-on thread (7), characterized in that of the lug (6) which is open at a point of separation (8) one of the end portions (9) on the side of the point of separation is fixed at the connecting piece (3) along the edge (5) of the surface indentation (4), and the other end portion (10) is bent up from the edge (5) of the surface indentation (4), that upon introducing a necklace or tie-on thread (7) through the expanded point of separation (8) the bent-up end portion (10) can be pressed down onto the edge (5) of the surface indentation (4), and that the clear inner width (a) of the lug (6) is smaller than the clear inner width (c) of the edge (5) of the indentation and smaller than the outer width (b) of the thickened end portion (11) to be pressed into the surface indentation (4).

2. The fastening device as claimed in claim 1, characterized in that when appending a knotted pearl necklace (1) to a jewelry clasp (2), the knot (12) after the last pearl (13) is itself provided as a thickened end portion (11) of the necklace thread (7).

3. The fastening device as claimed in claim 1, characterized in that anchoring parts (14) adhered or clamped to the thread end form the thickened end portion (11).

* * * * *